United States Patent [19]

Kaneko

[11] 4,385,825

[45] May 31, 1983

[54] COPYING APPARATUS

[75] Inventor: Tamaki Kaneko, Fujisawa, Japan

[73] Assignee: Ricoh Co., Ltd., Japan

[21] Appl. No.: 374,199

[22] Filed: May 3, 1982

Related U.S. Application Data

[63] Continuation of Ser. No. 185,908, filed as PCT/JP79/00110, May 2, 1979, published as WO 79/01073, Dec. 13, 1979, § 102(e) date Jan. 4, 1980, abandoned.

[30] Foreign Application Priority Data

May 16, 1978 [JP] Japan ..... 53-57157

[51] Int. Cl.[3] ..... G03G 15/00; G03G 15/14

[52] U.S. Cl. ..... 355/3 SH; 271/3.1; 271/65; 355/14 SH; 355/26

[58] Field of Search ..... 355/3 R, 3 SH, 14 SH, 355/23, 24, 26; 271/3.1, 65, 186, DIG. 9

[56] References Cited

U.S. PATENT DOCUMENTS

| | | | |
|---|---|---|---|
| 3,615,129 | 10/1971 | Drawe et al. | 355/25 X |
| 3,645,615 | 2/1972 | Spear . | |
| 3,672,765 | 6/1972 | Altmann . | |
| 4,040,616 | 8/1977 | Clarkson et al. | 271/DIG. 9 X |
| 4,078,789 | 3/1978 | Kittredge | 271/65 |
| 4,123,155 | 10/1978 | Hubert | 355/26 |
| 4,133,522 | 1/1979 | Siegl | 271/65 X |
| 4,202,621 | 5/1980 | Yoshimura et al. | 355/3 SH X |
| 4,247,193 | 1/1981 | Kaneko et al. | 355/3 SH X |

OTHER PUBLICATIONS

DeWaters, Terry L., "Document Handling", Xerox Disclosure Journal, vol. 4, No. 5, Sep./Oct. 1979, p. 663.

*Primary Examiner*—Fred L. Braun

*Attorney, Agent, or Firm*—McGlew and Tuttle

[57] ABSTRACT

An electrophotographic copying apparatus capable of effecting dual-side copying and forming a multiple image. To automatically carry out an operation of dual-side copying, etc., apparatus for reversing a sheet (17) and for switching the path of transportation of a sheet (24,38,43,45,59) are provided. When necessary, a second switching device (25,39) for selectively delivering a sheet to an ejected sheet tray (28) is provided, or a device is provided to resupply a sheet (34,35,36) and a third switching device (32) is provided for automatically effecting delivery of a sheet to a collator.

8 Claims, 10 Drawing Figures

COPYING APPARATUS

This is a continuation, of application Ser. No. 185,908 filed Jan. 4, 1980, now abandoned.

DESCRIPTION

TECHNICAL FIELD

This invention relates to a copying apparatus which is capable of effecting copying on one side and on both sides.

BACKGROUND ART

In this type of copying apparatus, proposals have already been made for an apparatus comprising sheet feeding means for feeding one sheet after another from a stack of sheets, image forming means operable for forming an electrostatic latent image, developing and transfer printing, fixing means for the image formed on a sheet by the image forming means, sheet ejecting means for ejecting a sheet with which copying is finished, and sheet resupply means for receiving a sheet that has passed through the fixing means and feeding the sheet again to the image forming means for dual-side copying. The operation of arranging the sheets with which copying is finished in the correct order of pages in a copying machine has hitherto been performed manually, and when the number of sheets handled is large this operation is troublesome because it is time consuming and requires a lot of man power.

In the first-mentioned type of copying apparatus, it has hitherto been desired to effect arrangement of copy sheets in the correct order of pages, whether copying is effected on one side or on both sides. The present invention provides such copying apparatus.

SUMMARY OF THE INVENTION

Accordingly, the present invention provides, in a first-mentioned type of copying apparatus, sheet reversing means in a position posterior to the fixing means with respect to the direction of movement of the sheets, and switching means for selectively leading a sheet either to a path in which the sheet is subjected to a reversing action by the sheet reversing means or to a path in which no reversing action is performed. By these features, the sheets which should be arranged in the correct order of pages or the sheets which should be subjected to dual-side copying or multiple image forming on one side can be reversed and have their direction of movement changed or advanced without being reversed, when necessary.

Also, the present invention provides second switching means for selectively leading either to the sheet ejecting means or to the sheet resupply means a sheet that has been moved through either one of the two paths. By this feature, the sheet that has been reversed or not reversed can be discharged to an ejected sheet tray or supplied in the desired position to the sheet resupply means for effecting dual-side copying or multiple image forming on one side.

Also, the present invention provides, in a path of travel of sheets from the second switching means to the sheet resupply means, third switching means for selectively leading sheets to a collator or the sheet resupply means. By this feature, it is possible to supply to the collator the sheets in the position in which they can be arranged in the correct order of pages.

BRIEF DESCRIPTION OF THE DRAWINGS

IN THE DRAWING

Figure 1:
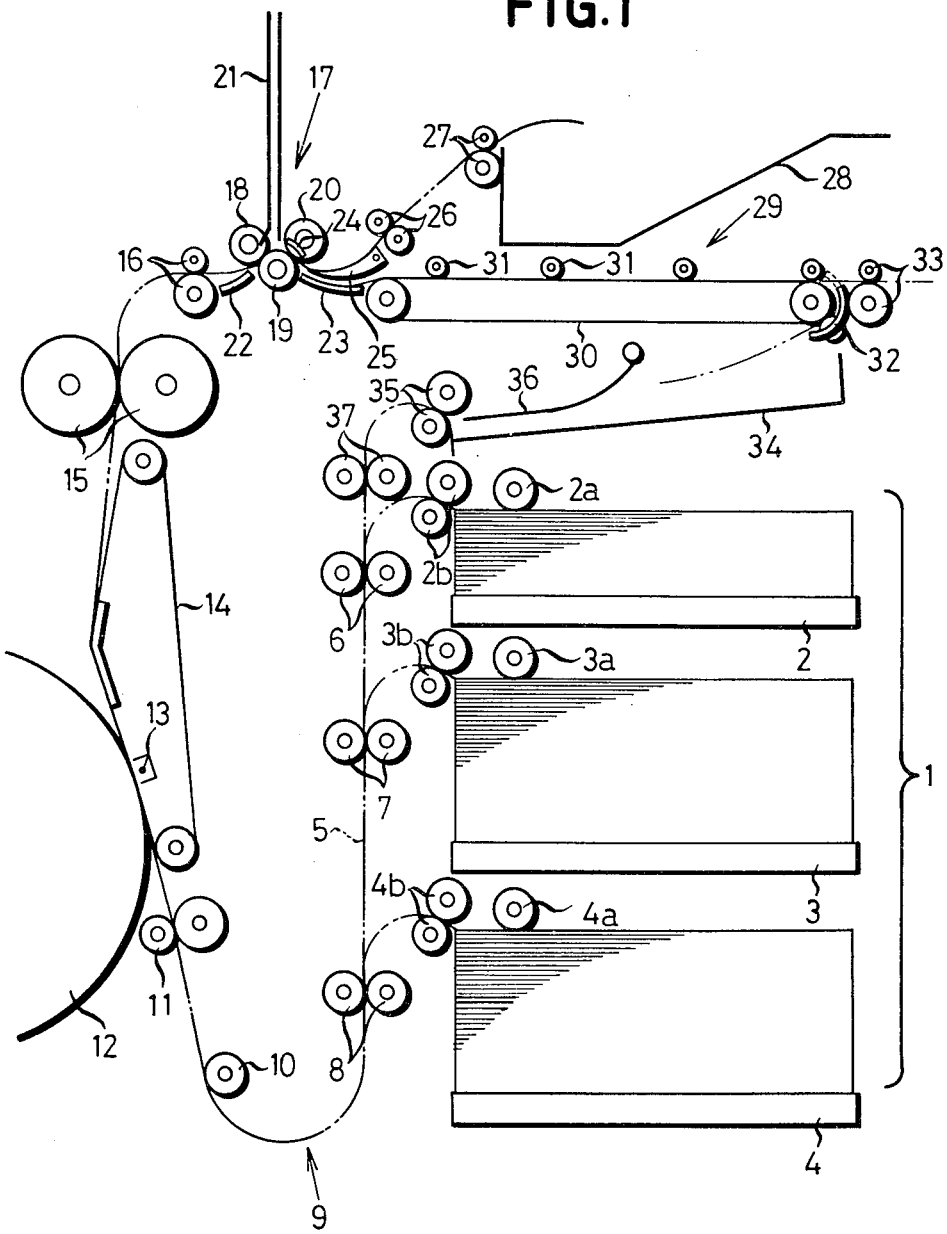
Figure 2:
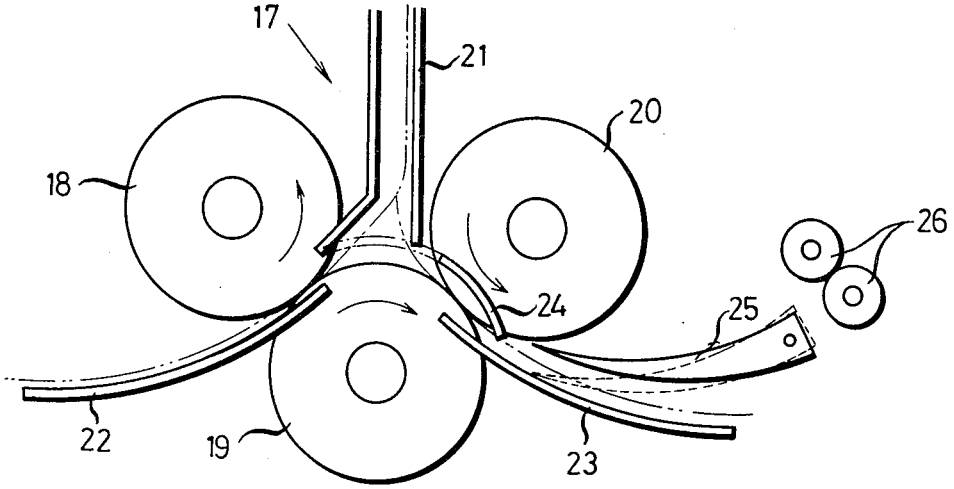
Figure 3:
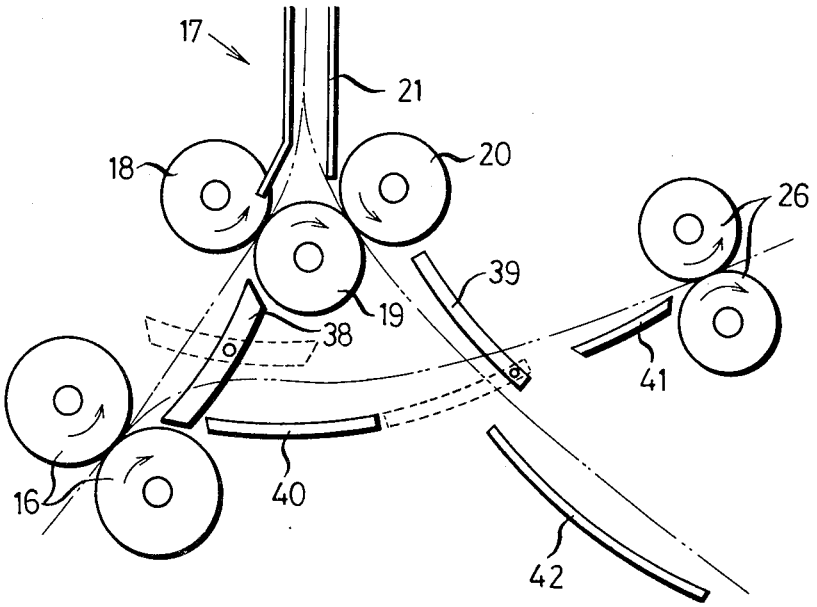
Figure 4:
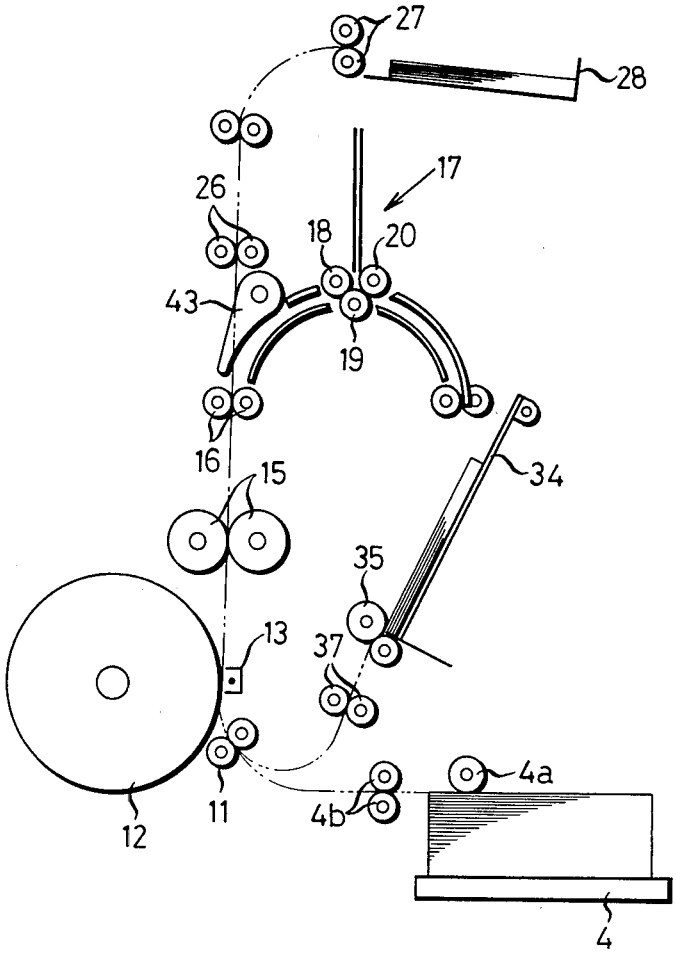
Figure 5:
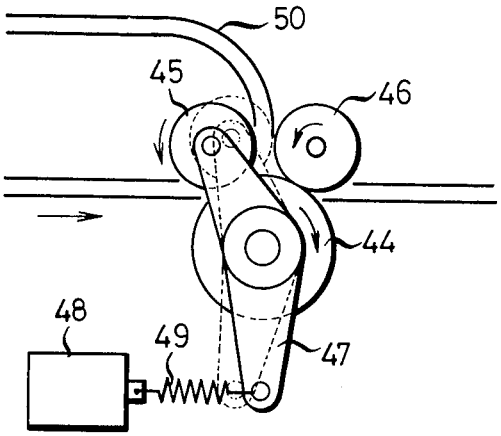
Figure 6:
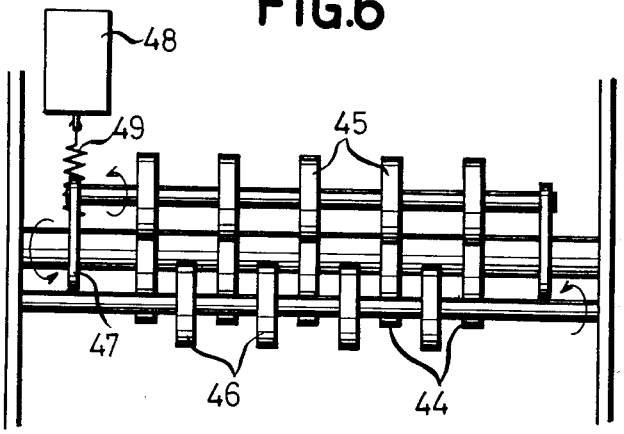
Figure 7:
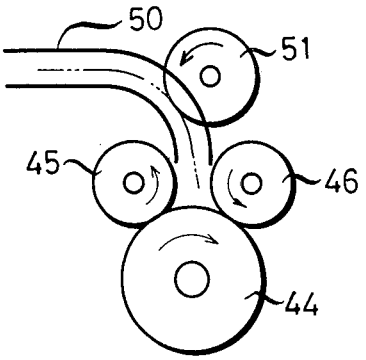
Figure 8:
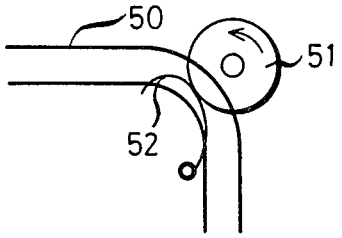
Figure 9:
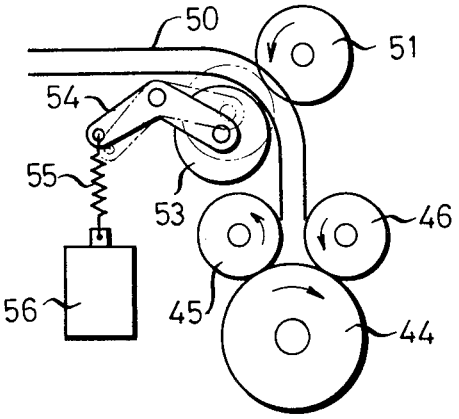
Figure 10:
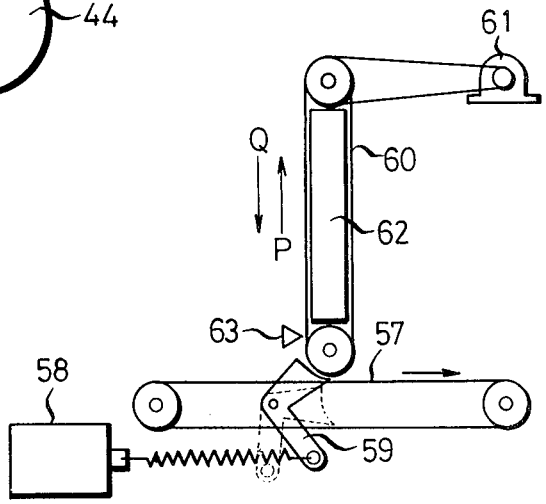

FIG. 1 is a schematic view of the copying apparatus in which this invention is incorporated;

FIG. 2 is a view, on an enlarged scale, of the reversing means according to the invention;

FIG. 3 is a view in explanation of another embodiment of the reversing means;

FIG. 4 is a view in explanation of the copying apparatus comprising another embodiment of the invention;

FIG. 5 is a side view of still another embodiment of the reversing means;

FIG. 6 is a plan view of the reversing means shown in FIG. 5 from which the reversing guide portion is removed;

FIGS. 7–9 are views in explanation of modifications of the reversing means shown in FIGS. 5 and 6 respectively; and FIG. 10 is a view in explanation of a further embodiment of the reversing means.

DESCRIPTION OF THE PREFERRED EMBODIMENT

In order to describe the present invention in more detail, the invention will be explained hereinafter by referring to the accompanying drawings.

In FIG. 1, a sheet feeding section 1 for feeding one sheet after another includes three sheet feeding tables 2, 3 and 4, each sheet feeding table being adapted to support a stack of sheets of different size. The sheet feeding tables are provided with sheet feeding rollers 2*a*, 3*a*, 4*a* for feeding the uppermost sheet and pairs of separating rollers 2*b*, 3*b*, 4*b* respectively. The lower roller of each pair of separating rollers rotates slowly in a direction opposite to the direction in which each sheet is fed, to thereby prevent a plurality of sheets from being accidentally fed at a time by the respective sheet feeding roller. A sheet from each sheet feeding table reaches a sheet feeding path 5 where it passes through pairs of dispatch rollers 6, 7, 8 to a buffer section 9, in which the sheet is adjusted with respect to its lateral position by diagonally directed rollers 10, before being sent to a pair of register rollers 11. Then the sheet is supplied to a transfer-printing section having a transfer-printer 13 in synchronism with a toner image formed on a photosensitive drum 12. The toner image on the photosensitive drum 12 is transfer-printed on the sheet, and the sheet is then separated from the photosensitive drum 12 with the cooperation of a separating belt 14, before being delivered to a pair of fixing rollers 15.

The sheet has the image thereon fixed by the pair of fixing rollers 15 and is moved through a pair of delivery rollers 16 to a train of reversing rollers of sheet reversing means 17. As shown clearly in FIG. 2, the train of reversing rollers includes a pre-reversing roller 18, a main reversing roller 19 in contact with the roller 18 and a post-reversing roller 20 in contact with the roller 19. The reversing means 17 further includes a reversing guide section 21 and has guide plates 22 and 23 located in a sheet introducing position and a sheet removing position respectively of the reversing means 17. 24 is a first switching guide plate capable of moving between a solid line position in which it guides the sheet entering the reversing roller train to the reversing guide section 21 for effecting reversing of the sheet and a broken line position in which it prevents the sheet from entering the reversing guide section 21 to allow it to be released from the reversing roller train without being reversed.

A second switching guide plate 25 is located in a path of movement of the sheet from the reversing means 17. When the second switching guide plate 25 is in a solid line position shown in FIG. 2, the sheet is led to conveyor belt means 29 shown in FIG. 1; when the second switching guide plate 25 is in a broken line position, the sheet is ejected onto an ejected sheet tray 28 through a pair of delivery rollers 26 and a pair of sheet ejecting rollers 27.

The conveyor belt means 29 comprises a belt 30 and rollers 31 cooperating therewith, and has a third switching guide plate 32 at the conveyor terminal portion. When the third switching guide plate 32 is in a solid line position, the sheet is sent by the conveyor belt means 29 to a collator through a pair of delivery rollers 33; when the third switching guide plate 32 is in a broken line position, the sheet is guided thereby to move to an intermediate tray 34. The intermediate tray 34 has a pair of rollers 35 for feeding the sheet again, 36 is a sheet hold-down member for keeping in position the sheets piled on the intermediate tray 34, and 37 is a pair of dispatch rollers for the sheet fed by the pair of rollers 35.

The manner of operation of the copying apparatus according to the invention in respect of the changing of the paths of movement of the sheet is as follows:

(1) When the first switching guide plate 24 and the second switching guide plate 25 are both in the broken line positions in FIG. 2, a sheet delivered from the fixing roller pair 15 is ejected onto the ejected sheet tray 28 without reaching the reversing guide section 21, to be stacked on the tray 28. This operation is the same as in copying apparatus of the prior art, and the sheets on the ejected sheet tray have their images facing upwardly, so that the sheets have pages arranged in the reverse order if copying starts at page 1.

(2) When the first switching guide plate 24 is in the solid line position and the second switching guide plate 25 is in the broken line position, the sheet which has copying effected on one side, for example, reaches the reversing guide section 21 where the sheet is reversed and released by the main reversing roller 19 and the post-reversing roller 20, to be delivered to the ejected sheet tray 28. At this time, the sheets on the ejected sheet tray have their images facing downwardly, so that the sheets are arranged in the order of pages.

(3) When the first switching guide plate 24 and the second switching guide plate 25 are both in the solid line positions in FIG. 2, the sheet subjected to a reversing action is delivered to the conveyor belt means 29.

When the third switching guide plate 32 is in the solid line position, the sheet is delivered to the collator.

When the third switching guide plate 32 is in the broken line position, the sheet which has copying effected on one side is delivered to the intermediate tray 34 in a position in which the image thereof faces upwardly, and then the sheet is fed by the pair of rollers 35 to a sheet feeding path 5 again. The sheet is fed to the image forming steps after the original is changed, to have an image copied on the opposite side. The sheet copied on both sides may be stacked on the ejected sheet tray 28 in the desired position by the operation of the first switching guide plate 24 and second switching guide plate 25, or delivered to the collator via the conveyor belt means 29.

(4) When the first switching guide plate 24 is in the broken line position and the second switching guide plate 25 is in the solid line position, the sheet is delivered to the conveyor belt means 29 without being subjected to the reversing action.

When the third switching guide plate 32 is in the solid line position, the sheet can be delivered to the collator.

When the third switching guide plate 32 is in the broken line position, a sheet which has copying effected on one side is stacked on the ejected sheet tray 28 in a position in which the image faces downwardly. Thus when this sheet is fed again to the image forming steps after the original is changed, multiple image forming can be effected on the same side or forming of an image in a multiplicity of colors can be effected by automatically changing the colors of developing agents. The sheet that has an multiple image (including an image in a multiplicity of colors) formed thereon may be stacked in the desired position on the ejected sheet tray 28 by the operation of the first switching guide plate and second switching guide plate, or delivered to the collator.

When copying is effected on both sides, a dual-side copying operation can be performed positively if a switch coupled to a signal from original feed means or a pressing plate is utilized for starting the pair of rollers 35 for feeding a sheet from the intermediate tray 34.

Also, while a series of steps for dual-side copying are followed, a sheet having no image formed on its underside may be passed through the sheet reversing means after an image is formed on the first surface, and ejected onto the ejected sheet tray 28 by passing through the second switching guide plate 25.

In FIG. 3, a first switching guide plate 38 is located in a path of travel of the sheet between the pair of delivery rollers 16 and the sheet reversing means 17, and a second switching guide plate 39 is located in a path along which the sheet is released from the sheet reversing means 17. 40, 41 and 42 are stationary guide plates. When the first switching guide plate 38 is in a solid line position, the sheet that has passed through the fixing means reaches the reversing means 17 where it is reversed and released by the main reversing roller 19 and post-reversing roller 20. Then the sheet is delivered to the conveyor belt means 29 when the second switching guide plate 39 is in the solid line position, and ejected onto the ejected sheet tray through the pair of feed rollers 26 when the second switching guide plate 39 is in the broken line position.

When the first switching guide plate 38 is in the broken line position, the sheet does not pass through the sheet reversing means 17 and is delivered either to the ejected sheet tray or to the conveyor belt means depending on the position of the second switching guide plate 39.

In the embodiment shown in FIG. 4, the sheet path is bifurcated in a position posterior to the pair of delivery rollers 16, one path leading to the ejected sheet tray 28 and the other path leading to the reversing means 17. Sheet switching means 43 is located in the bifurcating position to selectively lead the fixed sheet to the ejected sheet tray 28 or to the sheet reversing means 17. The sheet reaching the sheet reversing means 17 is subjected to a reversing action therein, and then sent to the intermediate tray 34 to be fed again. In this embodiment, dual-side copying can be effected by the first switching means alone, unlike the embodiment shown in FIGS. 1–3.

In FIGS. 5 and 6, the main reversing roller 44 rotates while being maintained in contact with the pre-reversing roller 45 and post-reversing roller 46 at all times, the pre-reversing roller 45 being rotatably supported on one arm of a lever 47 pivotally supported by a shaft of the main reversing roller 44, the other arm of the lever being connected to a plunger of a solenoid 48 through a spring 49. When the sheet is reversed, the pre-reversing roller 45 is in the solid line position, and the sheet held between the main reversing roller 45 and pre-reversing roller 45 when fed has its leading end guided by a reversing guide section 50, to be introduced thereinto. Upon the trailing end of the sheet releasing the two rollers 44 and 45, the sheet in the reversing guide section 50 is moved downwardly by gravity and the trailing end of the sheet is fed while being in contact with the circumferential surface of the main reversing roller 44, so that the sheet is released to outside by being held between the roller 44 and post-reversing roller 46, When it is not necessary to reverse the sheet, the solenoid 48 is energized to move the lever 47 and pre-reversing roller 45 from the solid line position to the broken line position, to thereby change the position in which the main reversing roller 44 is in contact with the pre-reversing roller 45. Thus the sheet fed by being held between the main reversing roller 44 and pre-reversing roller 45 is not led into the reversing guide section 50 but delivered to the main reversing roller 44 and post-reversing roller 46, to be discharged without being reversed.

The mechanism including the lever 47, solenoid 48 and spring 49 for changing the position in which the main reversing roller is in contact with the pre-reversing roller may be provided on either side, instead of being mounted on one side alone as shown.

In FIG. 7, the reversing guide section 50 shown in FIG. 5 has an ancillary delivery roller 51 arranged to rotate in the direction of an arrow. The ancillary delivery roller 51 may preferably be formed as of sponge, to enable a sheet delivered to the reversing guide section 50 to be positively released therefrom not only by gravity but also by the action of the roller 51. As shown in FIG. 8, a spring plate 52 may be provided to forcedly bring the sheet into contact with the ancillary delivery roller 51, to further ensure the release of the sheet.

In FIG. 9, a pressing roller 53 is arranged to move into and out of contact with the ancillary delivery roller 51. To this end, the pressing roller 53 is rotatably mounted on one arm of a double arm lever 54 and has its movement into and out of contact with the roller 51 controlled by a solenoid 56 connected to the other arm through a spring 55. When the sheet is moved into the reversing guide section 50 while being held between the main reversing roller 44 and pre-reversing roller to be subjected to a reversing action, the pressing roller 53 is moved away from the ancillary delivery roller 51. When the sheet in the reversing guide section 50 is released therefrom, the pressing roller 53 is brought into contact with the ancillary delivery roller 51 by the action of the solenoid 56, to thereby ensure that the sheet is positively released.

In the embodiment shown in FIG. 10, the sheet delivered to the sheet reversing means by a conveyor belt 57 is led to a reversing belt 60 which is disposed substantially vertically when a switching guide plate 59 under the action of a solenoid 58 is in a solid line position. At this time, the reversing belt 60 is moved in the direction of an arrow P by a motor 61, and a suction tank 62 is located inside the reversing belt 60 to attract the sheet to the reversing belt 60 to ensure that the sheet is fed by the reversing belt. 63 is an end senser detecting the trailing end of the sheet moved in the direction P by the reversing belt and its detection signal reverses the rotation of the motor 61 to move the reversing belt 60 in a direction Q. Thus the sheet moves downwardly, and is fed by the switching guide plate 59 in the delivery direction and conveyed by the conveyor belt 57.

When no reversing of a sheet is effected in the embodiment shown in FIG. 10, the switching guide plate 59 is moved by the action of the solenoid 58 to a broken line position which is outside the path of transportation by the conveyor belt 57. Thus the sheet conveyed by the conveyor belt 57 is released therefrom without being led to the reversing belt 60 and therefore without being reversed.

From the foregoing description, it will be appreciated that the copying apparatus according to the invention enables arranging of copies in the order of pages, dual-side copying and multiple copying to be effected automatically. In the invention, a multiple image includes an image in a multiplicity of colors.

I claim:

1. A copying apparatus comprising:

sheet feeding means (2*b*) for feeding one sheet after another from a stack (2) of sheets in a feed direction and to a first sheet feed path (5);

image forming means (12,13) disposed in said first path for receiving a sheet and for forming an electrostatic latent image, for developing the image and for transfer printing the image on the sheet;

fixing means (15) for fixing the image on the sheet, downstream of said image forming means and in said first path;

sheet ejecting means (27) at an end of said first path for ejecting the sheet with image and having an ejected sheet tray (28);

sheet resupply means (35) with an intermediate tray (34) for receiving the sheet with image and for supplying the sheet with image again to said image forming means over said first path for effecting dual surface copying of the sheet and for forming a multiple image on one side of the sheet;

sheet reversing means (17) located downstream of said fixing means and upstream of said sheet ejecting means and said sheet resupply means with respect to the feed direction;

a first sheet deflection switch (24) for selectively leading a sheet from said first path to a second path intersecting said first path in which the sheet is subjected to a reversing action by said sheet reversing means, and along said first path in which the sheet is not subjected to a reversing action; and a second sheet deflection switch (25) for selectively leading the sheet from said first and second paths to one of said sheet ejecting means and said sheet resupply means;

said first switch positioned upstream of said second switch in the feed direction;

said first switch having a first direction for deflecting sheets from said first path to said second path and a second direction for maintaining feeding of sheets along said first path;

said second switch having a first position for leading sheets along said first path to said ejected sheet tray whereby sheets are stacked in said tray face down and in order of copying, and for leading sheets that have passed from said first path to said second path and then back to said first path, to said ejected sheet tray whereby the sheets are stacked face up, said second switch means having a second position for leading sheets from said first path to a third path;

sheet conveying means for conveying sheets in a feed direction on said third path;

a third sheet deflection switch movable to intersect said third path for deflecting sheets into an intermediate tray whereby sheets are resupplied to said image forming means by said resupply means, said third sheet deflection switch movable into a position away from said third path for supplying sheets out of the copy apparatus;

whereby sheets deflected by said first switch to remain in said first path and by said third switch to be supplied to said intermediate tray receive dual surface copying and sheets deflected by said first switch to said second path and then back to said first path, and then to said intermediate tray by said third switch have multiple images formed on one surface thereof.

2. A copying apparatus according to claim 1, wherein said sheet reversing means comprises a main reversing roller, a pre-reversing and post-reversing roller in contact with said reversing roller, and a reversing guide section, said reversing guide section including a guide portion opening downwardly substantially vertically between said pre-reversing and post-reversing rollers, and containing said second path, said first switch comprising a guide plate for opening and closing the downwardly directed opening of said guide portion.

3. A copying apparatus according to claim 2, wherein said first switch comprises a curved plate curved outwardly of said reversing roller and spaced outwardly of said reversing roller, said curved plate mounted for movement around a portion of the circumference of said reversing roller.

4. A copying apparatus according to claim 1, wherein said sheet reversing means comprises a main reversing roller, a prereversing and a postreversing roller in contact with said main reversing roller, a reversing guide section enclosing said second path, said reversing guide section including a guide portion opening downwardly substantially vertically between said prereversing and postreversing rollers, said first switching means comprising a switching guide plate pivotally mounted upstream of said main reversing and prereversing rollers in sheet feed direction for diverting sheets to said third path from said first path and for maintaining sheets in said second path whereby sheets entirely bypass said sheet reversing means.

5. A copying apparatus as claimed in claim 1, wherein said sheet reversing means comprises a main reversing roller, pre-reversing and post-reversing rollers in contact therewith, and a reversing guide section, said reversing guide section comprising a guide portion opening downwardly substantially vertically between said pre-reversing and post-reversing rollers, said pre-reversing roller or said post-reversing roller being mounted such that it can move toward the post-reversing roller or the pre-reversing roller while being kept in contact with the main reversing roller, so that the pre-reversing roller or the post-reversing roller moving toward the other roller constituting said first switch for leading a sheet to the reversing guide section to subject it to the reversing action when moved away from each other and shortcircuiting the reversing guide section to feed the sheet without subjecting it to a reversing action when moved toward each other.

6. A copying apparatus as claimed in claim 1, wherein said reversing guide section is provided with an ancillary rotating feeding roller contacting a sheet delivered thereto for receiving a reversing action and delivering the sheet therefrom through an opening.

7. A copying apparatus as claimed in claim 6, further comprising a member resiliently forcing a sheet against the ancillary feeding roller.

8. A copying apparatus as claimed in claim 1, wherein said sheet reversing means comprises a reversing belt disposed substantially vertically, a motor for driving the reversing belt, and a detecting means detecting a sheet delivered to the reversing belt and controlling the motor in such a manner that the reversing belt is moved in the reverse direction.

* * * * *